United States Patent [19]

Sparks, Sr.

[11] 4,049,365

[45] Sept. 20, 1977

[54] OIL WELL PUMP WITH PLUNGER PULL DOWN AND DESANDING ASSEMBLY

[76] Inventor: Virgil H. Sparks, Sr., Box 2084, Bakersfield, Calif. 93303

[21] Appl. No.: 505,929

[22] Filed: Sept. 13, 1974

[51] Int. Cl.[2] ..... F04B 21/04; F01B 9/00

[52] U.S. Cl. ..... 417/554; 92/137

[58] Field of Search ..... 417/545–554, 417/539; 92/137

[56] References Cited

U.S. PATENT DOCUMENTS

| | | | |
|---|---|---|---|
| 195,253 | 9/1877 | Barnes | 417/552 |
| 856,271 | 6/1907 | Linthicum | 417/539 |
| 1,043,279 | 11/1912 | Wheeler | 417/552 |
| 1,163,535 | 12/1915 | Hazard | 417/550 |
| 1,268,964 | 6/1918 | Hahn | 417/554 |
| 1,640,406 | 8/1927 | Hawkins | 417/444 |
| 1,832,346 | 11/1931 | Yerkes et al. | 417/554 |
| 1,970,295 | 8/1934 | Fitzpatrick | 92/137 |
| 3,143,080 | 8/1964 | Sutliff | 417/554 |
| 3,777,626 | 12/1973 | Schurenberg et al. | 92/137 |

FOREIGN PATENT DOCUMENTS

| | | | |
|---|---|---|---|
| 60,698 | 5/1968 | Germany | 92/137 |
| 496,676 | 7/1954 | Italy | 417/552 |
| 324,593 | 1/1930 | United Kingdom | 417/554 |

*Primary Examiner*—William L. Freeh

*Attorney, Agent, or Firm*—Clarence A. O'Brien; Harvey B. Jacobson

[57] ABSTRACT

A pump of the reciprocating plunger type for use in an oil well in which structure is provided for pulling downwardly on the pump plunger during its downward stroke rather than relying upon the pump rod or sucker rod to push the plunger downwardly thereby eliminating lateral deflection of the pump rod or sucker rod and resultant wear and damage which frequently occurs especially when pumping heavy crude oil or the like. One embodiment of this structure involves a tension member connected with the walking beam and extending downwardly below the plunger, around a roller assembly or the like and then back upwardly for connection with the bottom of the plunger so that as the walking beam moves downwardly to move the pump plunger downwardly, the tension member will be tensioned for pulling the plunger downwardly without applying compressive force to the pump rod or sucker rod. Another embodiment of this structure provides a weight attached to the bottom of the plunger with the weight being reciprocal in a closed chamber so that it is not in contact with the fluid being pumped. The pump barrel is provided with a desander between the plunger and the standing valve and is in the form of a rod projecting upwardly in the pump barrel for extending into the lower hollow end of the pump plunger for removing sand therefrom to prevent sand from filling or clogging the lower end of the plunger.

6 Claims, 17 Drawing Figures

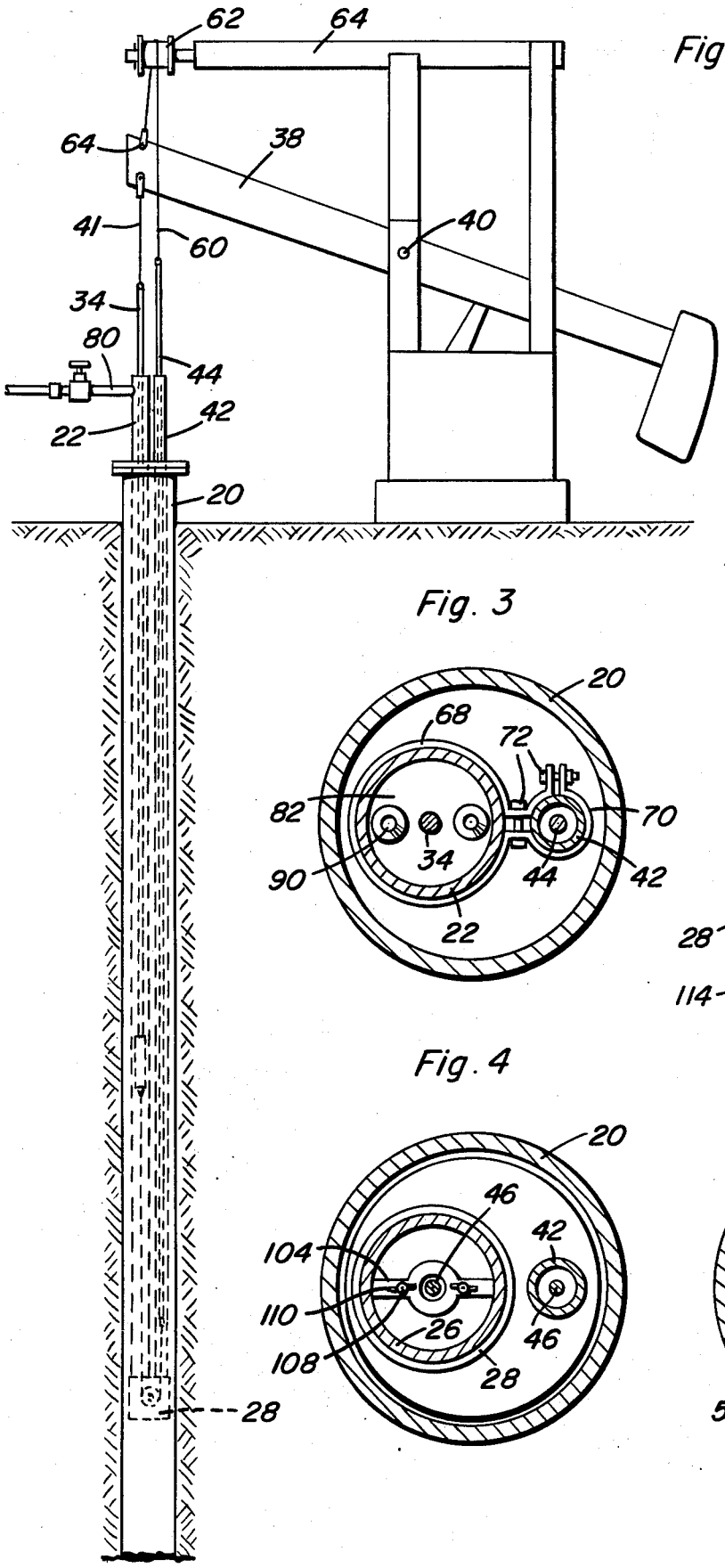
Fig. 1
Fig. 3
Fig. 9
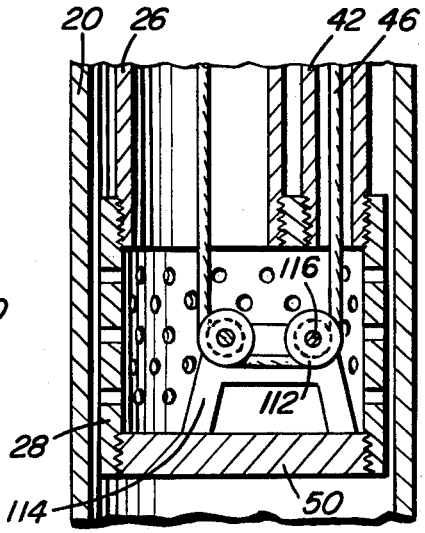
Fig. 4
Fig. 5
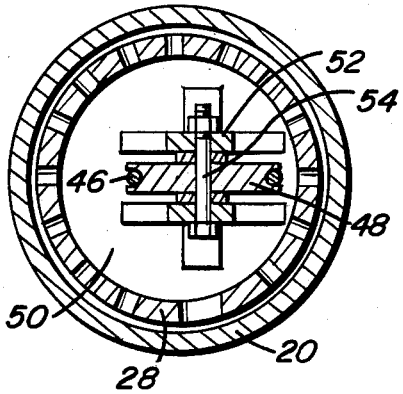

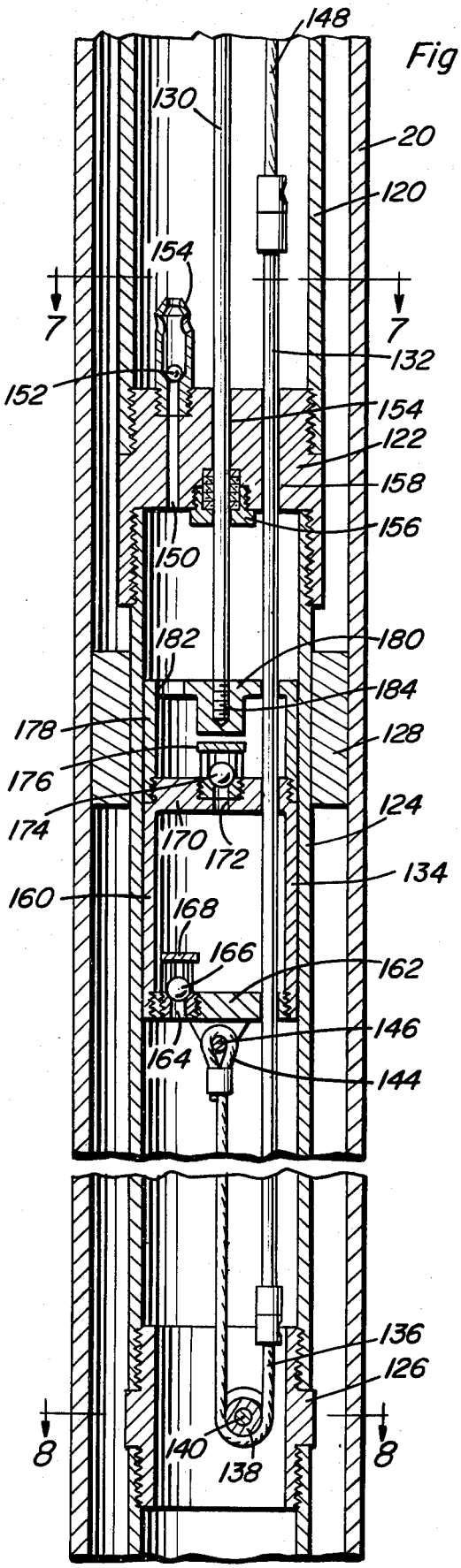
Fig. 6
Fig. 7
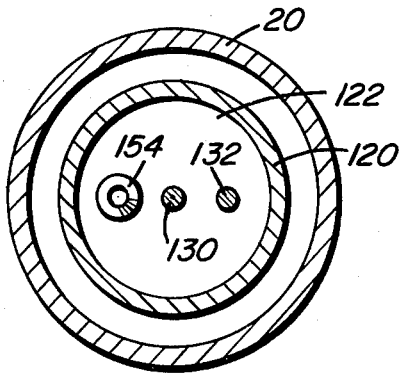
Fig. 8
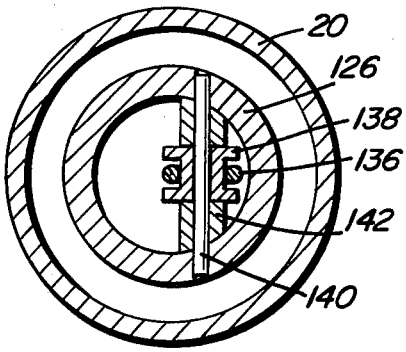
Fig. 14
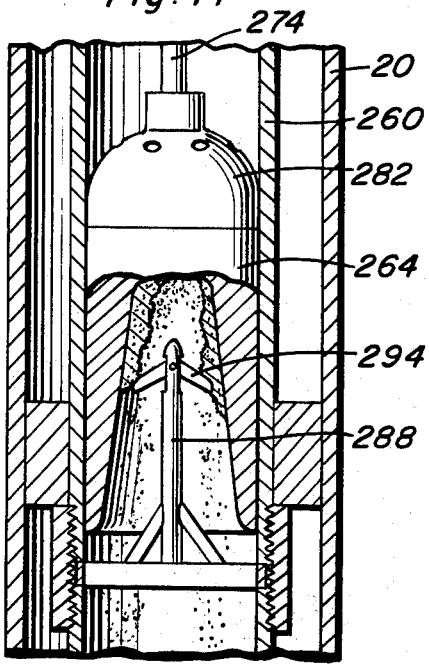

OIL WELL PUMP WITH PLUNGER PULL DOWN AND DESANDING ASSEMBLY

BACKGROUND OF THE INVENTION

1. Field of the Invention

The present invention generally relates to an oil well pump and more particularly a reciprocating plunger type pump having beams for exerting a downward force on the pump plunger to facilitate its downward movement without exerting compressive forces on the pump rod and a desander for preventing accumulation of sand in the bottom of the plunger.

2. Description of the Prior Art

Oil well pumps of the reciprocating plunger type are well known and employed in many installations. Examples of such pumps are found in prior U.S. Pat. Nos. 3,143,080, issued Aug. 4, 1964, and 3,765,482, issued Oct. 16, 1973. In present pumps, the pump plunger is reciprocating by a pump rod usually constructed from a plurality of connected sucker rods extending to ground level and connected with an actuating mechanism such as a walking beam which oscillates in a vertical plane. When pumping heavy oil or heavy oil, the plunger, when moving downwardly in the pump barrel, is retarded by the heavy oil which some times results in lateral flexing of the pump rod which causes the rod to engage the inner wall of the production tubing thus resulting in excessive wear to the pump rod and the production tubing and also results in reduced production due to the retarded movement of the plunger. Additionally, when pumping fluid having sand entrained therein, the bottom of the plunger which is normally hollowed and tapered toward the traveling valve in the plunger causes the sand to compact in the lower end of the plunger and in some instances clog or bridge across the hollow plunger, thus further restricting flow of oil through the plunger on the down stroke.

SUMMARY OF THE INVENTION

An object of the invention is to provide an oil well pump having a reciprocating plunger disposed in a pump barrel with the plunger having a traveling valve therein and being reciprocated by a pump rod string actuated from ground level by a suitable mechanism in which structural means is provided for pulling the plunger downwardly when the pump rod string is dropped downwardly by the actuating mechanism, thereby providing a positive downward movement for the pump plunger.

Another object of the invention is to provide a pump plunger having a conically shaped hollow lower end which will reduce the tendency of sand plugging the plunger and enable removable thereof by "bumping" the pump rod string or by "bumping" the plunger on the bottom portion of the pump barrel.

A further object of the invention is to provide a pump plunger of the type described in the preceding object in which a desanding rod is mounted in the pump barrel by using a special collar or the like which extends into the tapering hollow lower end of the pump plunger to remove sand therefrom.

Yet another object of the invention is to provide a pump plunger pull down apparatus in the form of a tension member which extends along side of the production tubing from a point above ground to a point below the pump plunger where it extends around the device anchored below the pump plunger with the upper end being connected to the operating mechanism for the pump rod string so that when the pump rod string is permitted to move downwardly, the pull down mechanism will positively pull the plunger and the pump rod string downwardly, thus facilitating pumping of heavy crude oil which normally tends to prevent downward drop of the pump rod string and plunger due to build up of asphalt, paraffin and the like.

Still a further object of the invention is to provide an oil well pump having a plunger provided with a pull down force in which such force is provided by a weight added to the plunger and connected thereto by a connecting rod in which the weight is reciprocated in a sealed chamber isolated from the heavy crude oil being pumped, thereby enabling the weight to exert a downward force on the plunger without the weight itself passing through heavy crude oil.

Yet another object of the invention is to provide an oil well pump provided with a circulating sub with a shear pin to enable the tubing string to be drained when desired.

Still another important feature of the invention is to provide an oil well pump for more effectively pumping heavy crude oil similar fluids, eliminating sanding problems in the plunger and providing positive pull down of the plunger or pull down by added weight to the plunger.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a schematic illustration of the oil well pump of the present invention with the plunger pull down assembly associated with the pump and its operating mechanism.

FIG. 3 is a transverse, sectional view taken substantially upon a plane passing along section line 3—3 of FIG. 2 illustrating the structure for supporting the pull down receiving pipe from the production tubing.

FIG. 4 is a transverse, sectional view taken substantially upon a plane passing along section line 4—4 of FIG. 2*a* illustrating the orientation of the desanding rods in the lower end of the pump barrel.

FIG. 5 is a transverse, sectional view taken substantially upon a plane passing along section line 5—5 of FIG. 2*a* illustrating the pulley mechanism at the lower end of the pump barrel in the perforated collar.

FIG. 6 is a vertical sectional view illustrating a modified form of pump and plunger pull down in which the pull down mechanism is oriented within the production tubing.

FIG. 7 is a transverse, sectional view taken substantially upon a plane passing along section line 7—7 of FIG. 6 illustrating the relationship of the production tubing, pump rod string and plunger pull down mechanism.

FIG. 8 is a transverse, sectional view taken substantially upon a plane passing along section line 8—8 of FIG. 6 illustrating the structural details of the roller or pulley at the lower end of the pump plunger receiving the pull down mechanism.

FIG. 9 is a fragmental sectional view of the pump barrel with the plunger pull down mechanism somewhat similar to the lower end portion of FIG. 2*a* but illustrating a modified form of anchor device for the pull down mechanism.

FIG. 14 is a fragmental sectional view of the desander and plunger illustrating their association when the desander is received in the lower end of the plunger.

DESCRIPTION OF THE PREFERRED EMBODIMENT

Figure 2:
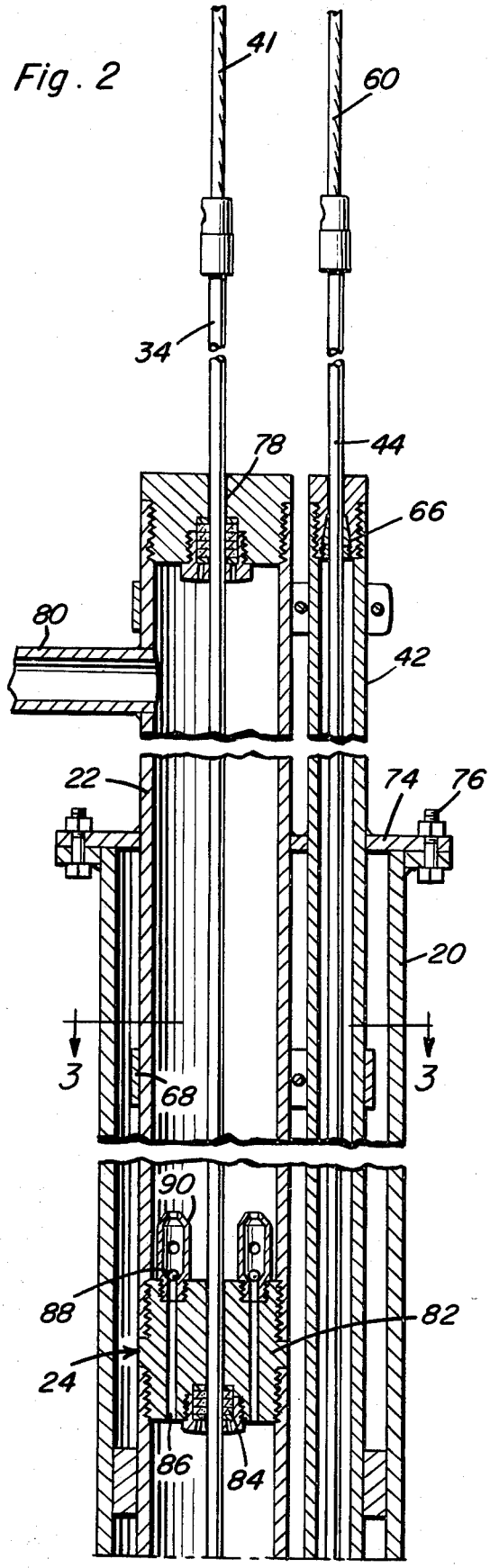
FIG. 2 is a longitudinal, vertical section of the upper portion of the assembly of FIG. 1.

Referring now specifically to the drawings, the embodiment of the oil well pump illustrated in FIGS. 1-5 is schematically illustrated in association with an oil well casing 20 in which the production tubing 22 is disposed with the lower end of the production tubing including a standing valve 24, a pump barrel 26 and a perforated collar 28 which are inserted in the casing 20 in a well known manner with a pack off 30 being provided between the casing 20 and the pump barrel 26 above the production zone and above the perforated collar 28. A reciprocating plunger 32 is disposed in the pump barrel 26 for vertical reciprocation by a pump rod string 34 which includes a lower polish rod 36 or the like and which extends above ground level for connection with a walking beam 38 which is oscillated in a vertical plane about a horizontal pivot such as pivot point 40 in a well known manner. The walking beam 38 is connected to the pump rod string 34 in any conventional manner such as by a flexible cable 41 or the like and the walking beam 38 may be counterbalanced and operated in a conventional manner with the walking beam, its operating mechanism and its supporting structure being completely conventional for reciprocating the pump plunger 32 in a well known manner.

Figure 2A:
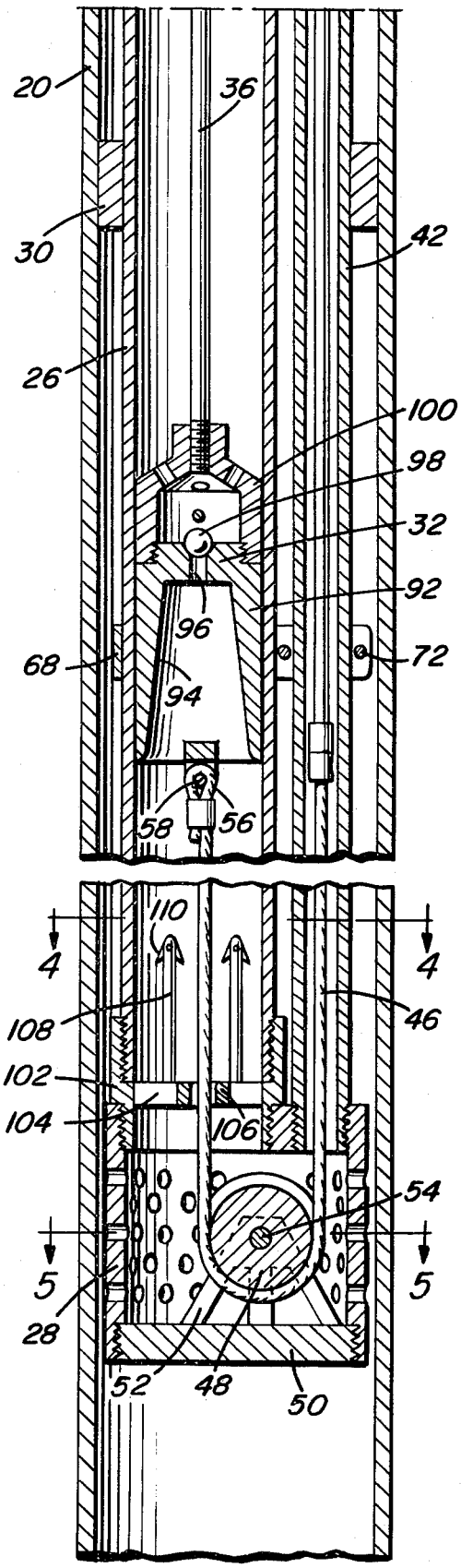
FIG. 2*a* is a longitudinal sectional view of the lower portion of FIG. 1 illustrating the pump structure and the plunger pull down mechanism associated therewith.

When the pump is used to pump heavy crude oil or similar fluid, the pump plunger 32 and the pump rod string 34 some times will not move vertically downwardly at a desired speed so that when the walking beam pulls the pump rod string upwardly the plunger either has not reached bottom thus reducing its stroke or the rate of reciprocation of the plunger is otherwise slowed due to build up of asphalt, paraffin and the like as well as the viscosity of the fluid being pumped. While the pump rod string is some times constructed of a plurality of sucker rods rigidly connected together and connected positively to the walking beam so that the pump rod string can be forced downwardly by exerting compression forces on the upper end thereof, this results in lateral bending or deflection or folding of the pump rod string 34 and in some instances results in wear of the pump rod string, wear of the tubing 22 breakage of the pump rod string and puncturing of the tubing. In order to alleviate this problem, a vertical pipe 42 is oriented in the casing 20 along side of the production tubing 22 with the pipe 42 receiving a pull down rod 44 that is generally parallel to the pump rod string 34. As illustrated in FIG. 2*a* the pipe 42 extends through the pack off and to a point below the plunger where it is connected to the upper end of the perforated collar 28. The pull down rod 44 is reciprocally mounted in the pipe 42 and at its lower end, the pull down rod 44 is connected with a cable 46 that extends from the bottom end of the pipe 42 into the hollow interior of the perforated collar 28. The cable 46 passes under a grooved pulley, roller or sheave 48 that is rotatably supported from the bottom plate 50 of the perforated casing 28 by upstanding supporting brackets 52 and a transverse bearing pin or bolt 54. The cable 46 then extends upwardly into the bottom end of the pump barrel 28 and is anchored to the lower end of the pump plunger 32 by a loop 56 being formed on the end of the cable and being oriented over a traverse rod of pin 58 on the bottom end of the plunger 32. As illustrated in FIGS. 1 and 2 the upper end of the pull down rod 44 is connected with a similar cable 60 which extends upwardly beyond the walking beam 38 and over top of a roller 62 that is journaled from a suitable support structure 64 with the cable 60 then extending downwardly and being connected to the walking beam at its upper edge as indicated at points 64 which is in opposite relation to the point of connection between the walking beam 38 and the pump rod string 34. Thus, in effect the cable 60, pull down rod 44, cable 46, plunger 32 and pump rod string 34 including the polish rod 36 and cable 41 act as a continuous cable or flexible member connected to the walking beam 38 so that as the walking beam 38 is oscillated in a vertical plane, the pump plunger 32 will be positively moved in both directions with the plunger 32 being moved upwardly when the point of connection between the walking beam 38 and the pump rod string 34 is moved upwardly and the plunger being pulled downwardly when the walking beam moves downwardly, thus moving the point of connection 64 between the walking beam 38 and the cable 60, rod 44 and cable 46 is pulled downwardly, thus eliminating any compressive forces being exerted on the pump rod string 34 and eliminating any tendency of the pump rod string to flex or bend laterally and come into contact with the production tubing.

As illustrated in FIG. 2, the pipe 42 which receives the pull down rod 44 is provided with a packing 66 at its upper end since it is in communication with the production zone and the pack offs 30 also enclose the pipe 42 as well as the production tubing 22 to properly orient the pipe 42 and production tubing 22 within the casing 20. For positioning the pipe 42 in relation to the production tubing 22, a clamp ring 68 is provided around the production tubing and includes an extension clamp ring 70 around the pipe 42 as illustrated in FIG. 3 with clamp bolts 72 being provided for securing the pipe 42 in position and maintaining the parallelism of the pipe 42 with the production tubing 22 with the clamp rings being oriented and longitudinally spaced at points along the length of the production tubing 22 and pipe 42. The closure cap 74 for the casing 22 rigidly receives the pipe 42 and production 22 in a well known manner such as by welding or the like and the cap 74 is secured to the casing 20 by bolt 76 or the like with the production tubing also including an upper seal or packing 78 and a production pipe 80 extending laterally therefrom to a suitable storage area or the like, all of which represents conventional structure.

As illustrated in FIG. 2, a standing valve 24 is incorporated into the production tubing above the plunger 32 and includes a valve body 82 made up into the production tubing and having a central bore with the polish rod 36 extending therethrough with a packing 84 at the lower end thereof and a plurality of longitudinal passageways 86 therethrough. The passageways 86 are each provided with a ball valve 88 at the upper end thereof oriented within a perforated cage 90 to retain the ball valve in place so that fluid being pumped upwardly by the plunger 32 will pass through the standing valve 24 thus eliminating hydrostatic head on the plunger when it is pulled downwardly.

The plunger 32 includes an elongated skirt 92 having a conically shaped hollow interior 94 communicating with the bottom thereof and a passageway 96 in the upper end thereof having a ball valve 98 engaged therewith, thus forming a traveling valve with the upper end of the passageway 96 forming a valve seat for the ball valve 98. A perforated cage 100 for the ball valve is connected to the upper end of the skirt 92 and is connected to the lower end of the polish rod 36 in a well known manner so that as the plunger is reciprocated, oil will be pumped up through the passageway 96 and out through the perforated cage in a well known manner as the plunger moves downwardly and when the plunger moves upwardly, the traveling valve 98 will close thus moving fluid upwardly in the pump barrel 26 and up through the standing valve 24, with this operation of the reciprocating plunger being conventional.

As illustrated in FIG. 2*a*, the lower end of the pump barrel 26 is provided with a collar 102 threaded to the lower end of the pump barrel 26 having the perforated collar 28 threaded thereon. The collar 102 includes a transversely extending relatively narrow supporting member 104 which has a central aperture 106 for passage of the cable 46. The transverse supporting plate or member 104 supports a pair of upstanding desanding rods 108 which are oriented on opposite sides of the cable 46 and are adapted to extend upwardly into the bottom end of the hollow interior 94 of the plunger 32 when it is at its lowermost position for removing any sand that may be packed into the hollow interior area 94. The upper ends of the desanding rods 108 may be provided with inverted V-shaped hook-like barbs 110 to facilitate removal of sand from the hollow interior 94 of the plunger skirt 92.

With this construction the pump plunger 32 is reciprocated positively in both an upward and downward direction and the pump plunger 32 is retained in a substantially sand-free condition. FIG. 9 illustrates a variation of this embodiment of the invention in which all of the components are the same except for the structure receiving the lower portion of the cable 46. The structure in FIG. 9 includes a pair of side by side grooved pulleys or rollers 112 supported by brackets 114 rigid with the bottom plate 50 and journaled about transverse pins or bolts 116. This structure operates in the same manner as the structure illustrated in the lower portion of FIG. 2*a* but enables the use of two smaller pulleys rather than the one larger pulley with the tangents to the remote edges of the pulleys 112 being in alignment with the center of the pipe 42 and the center of the pump barrel 26, respectively, which is the same relationship as the tangents to the opposite side edges of the single pulley 48 illustrated in FIG. 2*a*.

FIGS. 6–8 illustrate another embodiment of the pull down structure for a reciprocating plunger with a differently constructed plunger from that illustrated in FIGS. 1–5. In this construction, the production tubing 120, standing valve 122, pump barrel 124 and pull down anchor collar 126 are assembled and inserted into the casing 20 in a conventional manner with a pack off 128 being provided between the casing 20 and the pump barrel 124 above the production zone. In this construction, the pump rod string, sucker rod or polish rod 130 and the pull down rod 132 are both oriented within the production tubing 120 with the pull down rod 132 extending through the standing valve 122 and the pump plunger 134 to a point adjacent the anchor collar 126. A cable 136 is connected to the lower end of the rod 132 and extends around a grooved pulley or roller 138 rotatably journaled on a transverse pin or rod 130 extending transversely of the annular anchor collar 126 which is threaded to the barrel 124 and the lower portion of the pump which may involve a perforated collar or a bottom valve if one is used. The pulley is maintained in spaced relation to the interior surfaces of the collar 126 by spacers 142 as illustrated in FIG. 8 with the cable 136 extending upwardly into the lower end of the pump barrel and terminating in a loop 144 attached to a transverse pin 146 rigid with the lower end of the plunger 134. The upper end of the pull down rod 132 is connected with a cable 148 with the cable 148 extending upwardly to a roller that is supported above the walking beam so that the cable 148 extends around the roller and downwardly and is connected to the walking beam in the same manner as illustrated in FIG. 1 with the pump rod string also being connected to the walking beam so that the plunger 134 is reciprocated positively within the pump barrel 124 in the same manner as discussed in detail in connection with the embodiment illustrated in FIG. 1–5.

In this construction, the standing valve 122 is provided with a threaded connection to the production tubing 120 and a threaded connection with the barrel 124 in a conventional manner and provided with one or a plurality of passageways 150 each of which is provided with a ball valve 152 and a ball valve cage 154 in the upper end thereof for relieving the plunger of hydrostatic pressure during its downward movement in the same manner as in the embodiment illustrated in FIGS. 1–5. Also, a central passageway or bore 156 is provided for passage of the polish rod 130 with a suitable packing assembly 156 being provided at the lower end thereof. In addition, the rod 132 may be provided with a packing where it passes through a bore 158 in the standing valve 122 since it also passes through the working chamber of the pump between the plunger 134 and the standing valve 122.

The plunger in this construction includes a generally cylindrical member 160 having a lower closure plate 162 to which the transverse pin 146 is connected together with a valve seat 164, a ball valve 166 and a cage 168 therefor to enable entry of fluid being pumped into the interior of the sleeve or skirt 160. The upper end of the skirt 160 is provided with a closure plate 170 having a valve seat 172 therein, a ball valve 174 and a cage 176 therefor so that the ball valves 166 and 174, in effect, form a double traveling valve or a two-stage traveling valve so that the fluid being pumped is moved from a position below the plunger 134 into the interior of the plunger 134 and then up through the valve 174. The upper end portion of the plunger 134 is provided with a cylindrical extension 178 having a top plate 180 provided thereon and provided with apertures 182 for passage of fluid being pumped with the lower end of the polish rod 130 being connected to the plate 180 as at 184. This embodiment of the invention operates in generally the same manner as the other embodiment insofar as the pull down on the plunger is concerned so that the plunger and the pump rod string both are positively pulled downwardly to their lowermost position and also pulled upwardly to their uppermost position in a positive manner in response to oscillation of the walking beam or any other operating mechanism normally employed for reciprocating the pump plunger.

Figure 15:
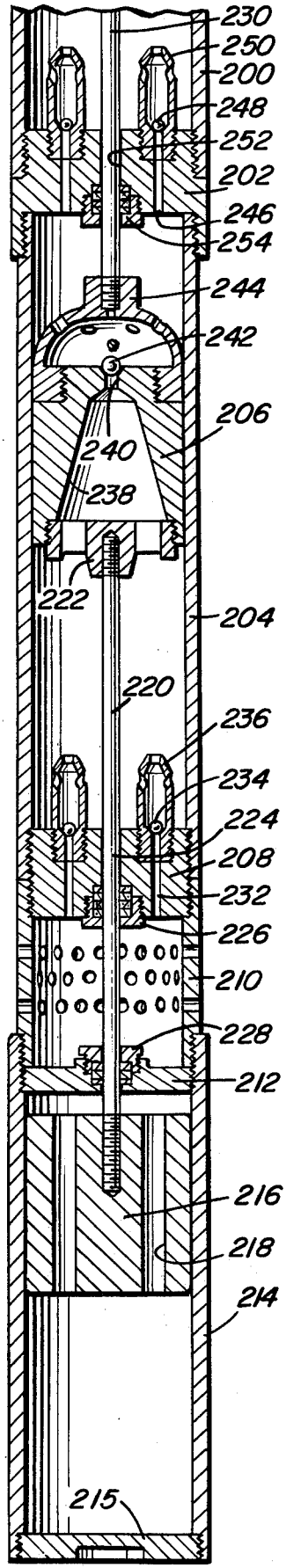
FIG. 15 is a vertical sectional view of a pump illustrating a weight connected with the bottom of the plunger and oriented in a casing isolated from the material being pumped.

FIG. 15 illustrates another embodiment of the structure for exerting a downward pull on the plunger and pump rod string in which the production tubing 200 is made up with an upper standing valve 202, a pump barrel 204 having a pump plunger 206 reciprocating therein toward and away from a bottom standing valve 208 and a perforated collar 210 below the bottom standing valve. Below the bottom closure plate 212 for the perforated collar 210, there is provided a cylindrical tubular sleeve 214 having a closure plate 215 in the lower end thereof so that the plates 212 and 215 isolate the interior of the sleeve from the oil being pumped. Disposed for free sliding movement within the sleeve 214 is a weight 216 which may conveniently be of cylindrical construction and generally similar in configuration to the interior of the sleeve 214 for guided movement therein. The weight 216 is provided a plurality of vertical bores 218 extending from end to end thereof with the interior of the sleeve being filled with a fluid such as light oil or the like. The light weight oil can move through the bores 218 so that the weight 216 can move vertically within the sleeve 214 without restriction or with very little restriction. The weight 216 is used to urge the plunger 206 downwardly with the weight being connected to the plunger 206 by the use of a lower polish rod 220 that is connected to a garbut nut 222 screwed into the bottom end of the plunger with the lower polish rod 220 extending through a bore 224 in the bottom standing valve 208, through a packing 226 in the lower end thereof, through the perforated collar 210 and the bottom plate 212 with a seal or packing 228 being provided for the lower polish rod 220 where it passes through the plate 212. This arrangement isolates the interior of the sleeve 214 from the heavy crude oil being pumped and enables the weight 216 to exert a downward force on the plunger 204, and even though this weight must be lifted when the plunger is lifted by the pump rod string 230 it will exert a desirable downward gravitational force on the plunger 206 when the pump rod string 230 is being lowered, thus producing a constant downward force on the plunger 206 independent of changes in the viscosity of the fluid being pumped.

In this embodiment of the pump, the lower standing valve 208 is provided with passageways 232 therethrough each of which is provided with a ball valve 234 and perforated cages 236 therefor to provide inlet of fluid being pumped through the perforated collar 210 up through the bottom standing valve 208 to a position between the bottom standing valve 208 and the plunger 206. The plunger 206 is provided with a hollow interior of conical shape 238 having a passageway in the center upper end thereof at 240 which is provided with a ball valve 244, thus providing a traveling valve in the plunger 206. The ball valve 242 is retained in position by a perforated cage 244 connected to the upper end of the plunger 206 and having at its upper end a connection with the polish rod forming part of the pump rod string 230. The upper standing valve or top standing valve 202 is likewise provided with a plurality of bores or passageways 246 each of which is provided with a ball valve 248 and a perforated cage 250 to remove hydrostatic head from the plunger 206 during its downward stroke. The top standing valve 202 is also provided with a passageway or bore 252 extending therethrough receiving the polish rod with a packing 254 being provided therefor to retain the compression compartment of the pump at the upper end of the barrel sealed in relation to the production tubing 200.

FIGS. 10–14 disclose a pump structure that does not use the plunger pull down feature but includes a novel desanding assembly and other pump features. In this construction, the pump barrel 260 is oriented in the casing 20 and provided with a pack off 262 between the casing and the pump barrel 260 above the production zone. The pump plunger 264 is provided with a hollow, generally conically shaped interior 266 communicating with the bottom of the plunger and provided with a passageway 268 with a valve seat in its upper end. A ball valve 270 is provided on the valve seat and forms a traveling valve in the pump plunger. The pump plunger 264 is provided with a perforated cage 272 on the upper end thereof to retain the ball in place and enable passage of fluid up through the plunger 264 and a polish rod 274 is connected to the cage 272 so that reciprocation of the polish rod 274 will reciprocate the plunger 264 in a well known manner. Attached to the lower end of the pump barrel 260 is a bottom standing valve 276 having a ball valve 278 associated with a ball valve seat 280 and a perforated cage 282 to enable passage of fluid inwardly through a perforated collar 284 and up through the standing valve 276. The lower end of the perforated collar 284 is provided with the usual bull plug 286 if desired.

For preventing the packing of sand into the conical hollow area 266 of the plunger 264, a desanding rod 288 is provided and oriented centrally in the pump barrel 260 upwardly of the bottom standing valve 276. The desanding rod 288 is supported from a transverse supporting plate or strap 290 on a collar 292. The upper end of the desanding rod 288 is provided with a pair of outwardly extending and downwardly extending projections 294 which serve as hook devices so that when the plunger 264 moves to its lowermost position as illustrated in FIG. 14, any sand accumulated in the conical interior 266 will be effectively removed from the plunger, thus eliminating the packing of sand within the interior of the plunger. In addition, the specific construction and configuration of the conical interior area 266 has advantages over the conventional cylindrical skirt on a plunger since the conical configuration will tend to prevent packing or bridging of sand across the interior of the plunger and any sand will be more easily removed by merely tapping or bumping the pump rod string on by bumping the plunger on the bottom standing valve or the like when no desander is used.

Thus, the shape and configuration of the conical area 266 is effective to reduce the packing of sand in the plunger as compared with a conventional cylindrical skirt and also enables easier removal of the sand by tapping or bumping the pump rod string or plunger and also is adapted to be used in association with the desander which enters the hollow interior 266 to a substantial degree as illustrated in FIG. 14 in order to remove any sand compacted in this area.

Figure 10:
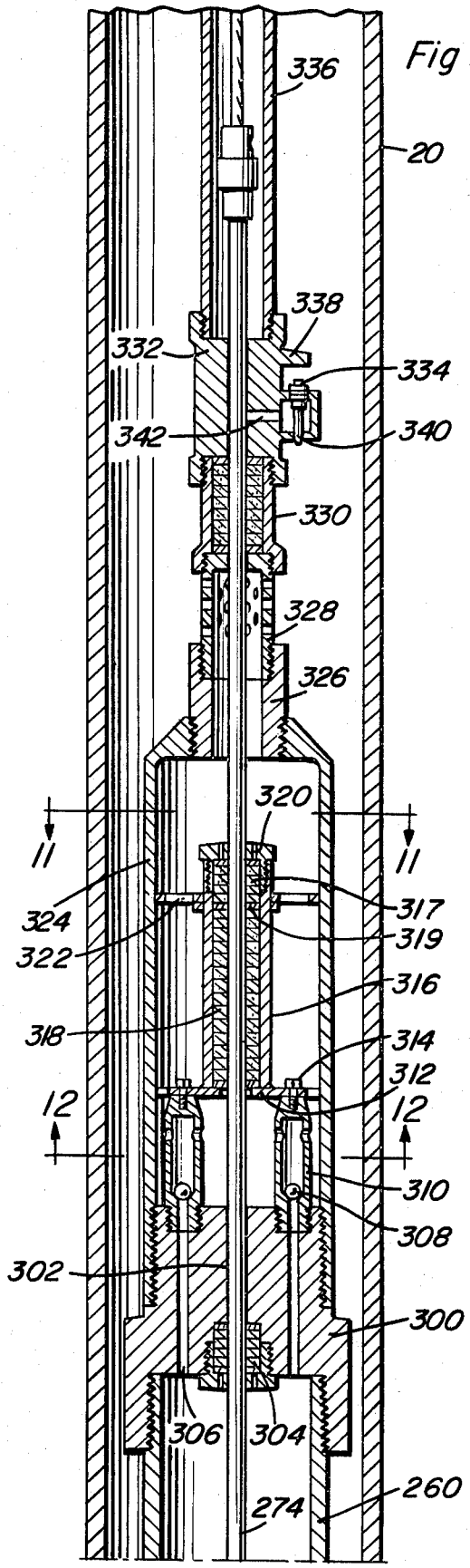
FIG. 10 is a sectional view of the upper portion of a pump similar to that illustrated in FIG. 2 but illustrating a modified pump structure.
Figure 10A:
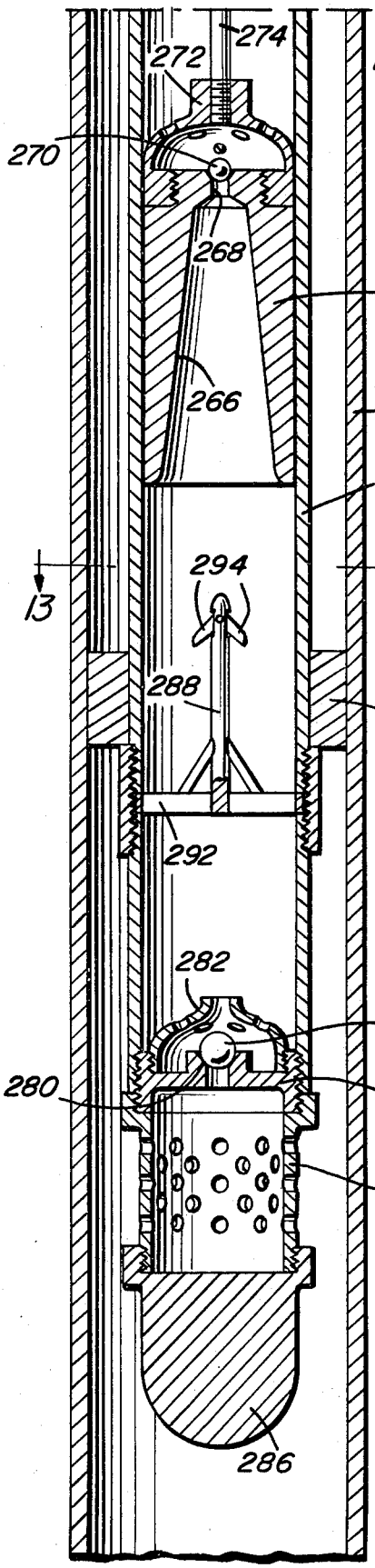
FIG. 10*a* is a sectional view of the lower portion of the pump structure of FIG. 10 illustrating the desander and its association with the plunger and bottom standing valve.

The pump construction in FIG. 10 also includes an upper standing valve 300 to which the pump barrel 260 is attached and which includes a central bore 302 receiving the polish rod 274. The standing valve 300 is provided with a packing 304 where the polish rod 274 exits from the bore 302 and is provided with a plurality of bores 306 each of which is provided with a ball valve 308 and a perforated ball cage 310 for removing the hydrostatic head from the pump plunger 264. Attached to the upper ends of the ball cage valves 310 is a plate 312 which is perforated and bolted to the cages by bolts 314. The plate 312 is rigidly affixed to a lifting nipple 316 as by welding or the like with the lifting nipple 316 including packing elements 318 and a retainer nut 320 for sealing the polish rod 302. The upper end portion of the lifting nipple 316 is provided with a perforated plate 322. The nut 320 on the packing may be perforated to enable pressure to pass downwardly to compress the packing 318 and a washer with a spring follower may be provided to compress the packing for extending the useful life thereof. This assembly is provided in a cover or casing 324 which is connected to the standing valve 300 which arrangement is used when the pump is to be used as an insert pump and a setting unit is provided at the bottom thereof rather than the bull plug 286. A tubing adaptor 326 is connected to the cover 324 and a perforated nipple 328 is provided for pumping out the annulus when desired. A sealing nipple 330 is provided above perforated nipple and a sub 332 with a drain plug 334 is provided with the sealing nipple 330 serving to retain the tubing 336 full of diesel fuel or the light weight lubricating fluid such as would be desired when heavy fuel is being pumped. An excess pressure will cause the drain plug shear a pin or otherwise move upwardly against a stop 338 to drain the tubing through a drain opening communicating with the annulus between the tubing and casing.

Figure 11:
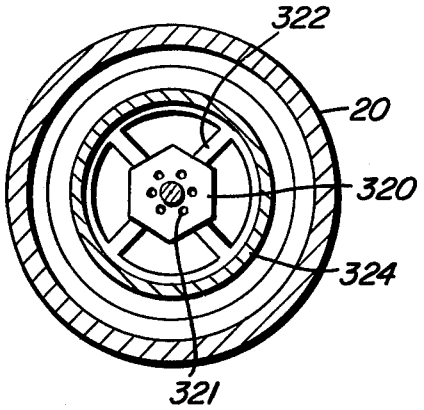
FIG. 11 is a transverse, sectional view taken substantially upon a plane passing along section line 11—11 of FIG. 10.
Figure 12:
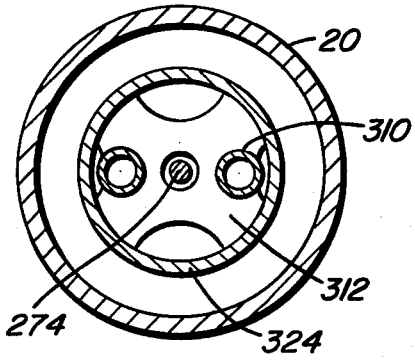
FIG. 12 is a transverse, sectional view taken substantially upon a plane passing along section line 12—12 of FIG. 10.
Figure 13:
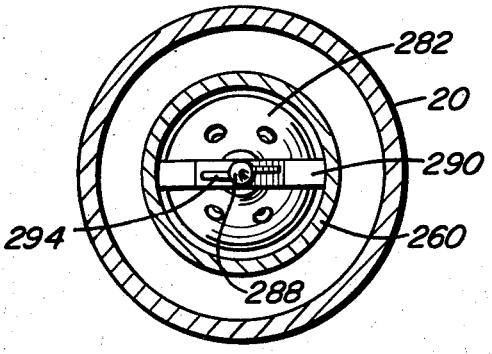
FIG. 13 is a transverse, sectional view taken substantially upon a plane passing along section line 13—13 of FIG. 10*a*.

The drain plug 336 may be provided with O-rings at the upper end and a shear pin at its upper end which retains the lower end thereof in the drain opening 340. By introducing excess pressure through the pressure entry passageway 342, the shear pin may be ruptured and the plug or pin 334 elevated to open the drain opening 340 with the fluid being directly downwardly from the drain opening 340 which will be of some assistance in helping to extricate sand locked pumps. FIG. 11 illustrates the apertures 321 in the plug or nut 320 for the packing which enables pressure in the lifting nipple 316 to assist the spring 317 is pushing downwardly against the washer 319 on the packing 318, thus providing for longer, more useful life of the packing.

The specific construction and arrangement of the upper standing valve may be varied as to the size and location of the ball valves, cages and passageways and the shape and configuration of the traveling valve and cage may be varied. The standing valve 300 may be altered as to its overall diameter to enable the pump to be used as an insert pump so that the entire assembly may be inserted into the production tubing when used as an insert pump.

The pump assemblies as disclosed provide a structure in the plunger itself to reduce the tendency of sand to pack into the bottom of the plunger due to its conical configuration and enables easier removal thereof by tapping or bumping the pump rod string or plunger against the bottom valve and in more extreme situations, the desander assembly may be associated with the plunger for entering the bottom of the plunger when the plunger is adjacent the lower end of its stroke for removing sand from the plunger. The pump and its various components may be of different sizes and may be made up into the production tubing or of the insert type. The pump with the pull down arrangement, either the isolated weight or the positive cable and rod type of pull down, is especially adapted for use in pumping heavy crude oil or other similar oils or fluids while the desanding feature is adapted for use in installations where the fluid being pumped has considerable sand entrained therein.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A pump adapted for use in an oil well for pumping heavy crude oil comprising a vertically disposed pump barrel having a lower end in communication with a production zone and an upper end communicating with storage facilities at ground level, a plunger reciprocally mounted in the pump barrel and including a pump rod string extending to ground level for actuation, said barrel and plunger including valve means for pumping fluid from a production zone to ground level, and pull down means connected to said plunger for exerting a downward force on the plunger and pump rod string connected thereto to facilitate downward movement thereof when pumping heavy crude oil, said pull down means including a tension member extending downwardly from the plunger, and means disposed externally of the barrel to exert a force on said tension member for pulling the plunger and pump rod string downwardly, said means disposed externally of the barrel including a weight attached to the plunger, said weight being disposed in a chamber below the barrel isolating it from the fluid being pumped, said chamber being closed with the weight closely fitting therein, said weight being connected to the plunger by said tension member in the form of a polish rod, said chamber including light weight oil in the interior thereof and said weight including passages therein to enable vertical reciprocation of the weight in the chamber without restriction and a packing in the upper end of the chamber sealing said polish rod.

2. A pump adapted for use in an oil well for pumping heavy crude oil comprising a vertically disposed pump barrel having a lower end in communication with a production zone and an upper end communicating with storage facilities at ground level, a plunger reciprocally mounted in the pump barrel and including a pump rod string extending to ground level for actuation, said barrel and plunger including valve means for pumping fluid from a production zone to ground level, and pull down means connected to said plunger for exerting a downward force on the plunger and pump rod string connected thereto to facilitate downward movement thereof when pumping heavy crude oil, said pull down means including a tension member extending downwardly from the plunger, and means disposed externally of the barrel to exert a force on said tension member for pulling the plunger and pump rod string downwardly, said tension member extending downwardly from the plunger around a lower anchor means and then upwardly to ground level for operation by the actuating means for the pump rod string so that when the pump rod string is lowered, the tension member is tensioned for pulling the plunger downwardly, said tension member being in the form of a flexible cable having one end anchored to the plunger, said lower anchor means including a roller having a peripheral groove under which the cable is entrained with the cable then extending vertically upwardly, a tension rod connected to the cable and extending to a position adjacent ground level, the pump rod string being actuated by a walking beam swingable in a vertical plane, said tension rod including a cable attached to its upper end extending over top of a roller above the walking beam and being terminally connected to the walking beam whereby the tension rod will be pulled upwardly, thus pulling the plunger downwardly when the walking beam swings downwardly to lower the pump rod string and plunger, said plunger including a hollow lower end of conical configuration tapering inwardly and upwardly to reduce the tendency of sand to clog the valve means in the plunger, and a desanding rod mounted in the pump barrel and extending axially therein for entering the hollow bottom end of the plunger when it approaches the lower end of its down stroke for removing sand from the plunger, the upper end of said desanding rod being provided with downwardly and outwardly extending projections to facilitate removal of sand from the plunger when the plunger moves upwardly away from the lower end of its down stroke.

3. In an oil well pump having a vertical pump barrel with standing valve means therein, a reciprocating plunger with traveling valve means in the pump barrel for pumping fluid longitudinally thereof, a polish rod connected to the plunger for actuation thereof, said plunger including a hollow skirt forming the lower end thereof, said traveling valve means including a perforated cage attached to the lower end of said polish rod and forming the upper portion of the plunger, the upper end of the skirt including a plate having a passageway therethrough, a ball valve engaged with the upper end of the passageway which forms a valve seat, the interior of the skirt tapering from a larger diameter at its bottom end toward a smaller diameter at its upper end, the upper end diameter of the tapering interior surface of the skirt being substantially larger than the diameter of the passageway to reduce the tendency of sand to pack into the bottom of the plunger, and a desanding rod mounted in the barrel and extending axially toward the lower end of the plunger for entering the lower end of the skirt of the plunger when the plunger approaches the lower limit of its down stroke for removing sand from the plunger.

4. The structure as defined in claim 3 wherein the upper end of said desanding rod is provided with downwardly and outwardly extending projection means thereon to facilitate removal of sand from the plunger when the plunger moves upwardly away from the lower limit of its downward stroke, said pump barrel including a standing valve in the lower end thereof below the plunger and a standing valve in the upper end thereof above the plunger, and a perforated nipple assembly connected with the upper end of the pump barrel to enable pumping out of the annular space above the pump barrel in an oil well casing, tubing extending upwardly from the perforated nipple assembly and receiving a pump rod string connected with the plunger for enclosing the pump rod string with the tubing adapted to receive a lightweight oil to facilitate reciprocation of the pump rod string.

5. In an oil well pump having a vertical pump barrel with standing valve means therein, a reciprocating plunger with traveling valve means in the pump barrel for pumping fluid longitudinally thereof, a polish rod connected to the plunger for actuation thereof, said plunger including a hollow skirt forming the lower end thereof, said traveling valve means including a perforated cage attached to the lower end of said polish rod and forming the upper portion of the plunger, the upper end of the skirt including a plate having a passageway therethrough, a ball valve engaged with the upper end of the passageway which forms a valve seat, the interior of the skirt tapering from a larger diameter at its bottom end toward a smaller diameter at its upper end, the upper end diameter of the tapering interior surface of the skirt being substantially larger than the diameter of the passageway to reduce the tendency of sand to pack into the bottom of the plunger, the lower end of said plunger being provided with a perforated supporting plate extending across the major diameter of the tapering internal surface of the skirt, a depending polish rod attached to said plate and disposed centrally thereof, said polish rod extending beyond the standing valve means externally of the lower end of the barrel, a weight attached to the lower end of the polish rod for pulling downwardly on the polish rod and plunger, a chamber in which said weight is movable with the chamber being isolated from the barrel, said chamber being provided with lightweight fluid therein and said weight being provided with apertures therethrough to enable vertical reciprocation of the weight in the chamber without substantial restriction.

6. A pump adapted for use in an oil well for pumping heavy crude oil, having a lower end in communication with a production zone and an upper end communicating with storage facilities at ground level, a plunger reciprocally mounted in the pump barrel and including a pump rod string extending to ground level for actuation, said barrel and plunger including valve means for pumping fluid from a production zone to ground level, and pull down means connected to said plunger for exerting a downward force on the plunger and pump rod string connected thereto to facilitate downward movement thereof when pumping heavy crude oil, said pull down means including a tension member extending downwardly from the plunger, and means disposed externally of the barrel to exert a force on said tension member for pulling the plunger and pump rod string downwardly, said tension member extending downwardly from the plunger around a lower anchor means and then upwardly to ground level for operation by the actuating means for the pump rod string so that when the pump rod string is lowered, the tension member is tensioned for pulling the plunger downwardly, said tension member being in the form of a flexible cable having one end anchored to the plunger, said lower anchor means including a roller having a peripheral groove under which the cable is entrained with the cable then extending vertically upwardly, a tension rod connected to the cable and extending to a position adjacent ground level, the pump rod string being actuated by a walking beam swingable in a vertical plane, said tension rod including a cable attached to its upper end extending over top of a roller above the walking beam and being terminally connected to the walking beam whereby the tension rod will be pulled upwardly, thus pulling the plunger downwardly when the walking beam swings downwardly to lower the pump rod string and plunger, said tension rod being reciprocally mounted in a vertical housing parallel to and externally of the pump barrel, said roller having one peripheral portion tangentially aligned with the center of the plunger and the opposite periphery tangentially aligned with the housing receiving the rod, said housing extending to ground level and connected with the cable which extends over top of the roller on the walking beam, said pump barrel including a plate at the lower end thereof, a desanding rod connected to the plate and extending toward the plunger for removing said therefrom when the plunger reaches its lower limit of downward movement, and a peripheral nipple connected to the lower end of the pump barrel, said roller being journaled within said perforated nipple.

* * * * *